US006177765B1

(12) United States Patent
Poljak et al.

(10) Patent No.: US 6,177,765 B1
(45) Date of Patent: Jan. 23, 2001

(54) ACTIVE DIODE PROTECTION APPARATUS IN METAL HALIDE LAMPS

(75) Inventors: Pamela L. Poljak, Strongsville; Raghu Ramaiah, Eastlake; Timothy P. Dever, Fairview Park, all of OH (US)

(73) Assignee: General Electric Company, Schenectady, NY (US)

( * ) Notice: Under 35 U.S.C. 154(b), the term of this patent shall be extended for 0 days.

(21) Appl. No.: 09/460,177

(22) Filed: Dec. 10, 1999

(51) Int. Cl.[7] ..... H01J 13/46

(52) U.S. Cl. ..... 315/72; 315/51; 315/60; 315/234; 315/335

(58) Field of Search ..... 315/72, 51, 60, 315/200 R, 234, 335, 71, 264; 313/25, 225, 318

(56) References Cited

U.S. PATENT DOCUMENTS 3,965,387 * 6/1976 Stuart et al. ..... 315/47
3,982,154 * 9/1976 Mize et al. ..... 315/51
4,007,397 * 2/1977 Lake ..... 315/51

* cited by examiner

*Primary Examiner*—Haissa Philogene
(74) *Attorney, Agent, or Firm*—Fay, Sharpe, Fagan, Minnich & McKee, LLP

(57) ABSTRACT

A metal halide lamp, having a cold fill pressure of at least 50 torr, incorporates a starter circuit with an active device to protect the diode included therein. The active portion of the starter circuit, either removes a voltage multiplying circuit portion, from the starter circuit or shorts out the diode by shunting action of the switch. The voltage multiplier circuit portion is connected across the main electrodes, wherein the voltage multiplier circuit portion increases the starting voltage applied to the starter electrode.

18 Claims, 4 Drawing Sheets

ACTIVE DIODE PROTECTION APPARATUS IN METAL HALIDE LAMPS

BACKGROUND OF THE INVENTION

The present invention relates to high pressure arc discharge lamps and is particularly applicable to lamps containing a metal halide fill and employing a tungsten electrode wherein the fill pressure has been increased to such a high value that a starting circuit is required within the lamp.

High pressure metal halide discharge lamps (MHL) are generally comprised of a f used silica or quartz arc tube containing an ionizable fill and having a pair of main thermionic electrodes at the ends. In most applications the electrodes include a relatively high percentage of tungsten. T he electrodes are supported by inleads which include a thin molybdenum ribbon portion extending hermetically through a pinch or press seal in the end of the lamp. Generally, a starter electrode is disposed in the arc tube adjacent one of the main electrodes to facilitate starting. In most lamps, a discharge can be ignited between the starter and the adjacent main electrode at a much lower voltage than between the two main electrodes, and ignition of the arc between the main electrodes is thereby facilitated.

Maintenance of initial lumens in MHL lamps is a problem due to the highly complex chemical reactions occurring in the atmosphere within the arc discharge chamber. More specifically, at the operating temperature of 5,500° K at the center of the arc, to approximately 1,100° K at the wall of the arc tube, which defines a boundary of the plasma, many and various reactions occur. One negative reaction is the transport of metallic and inorganic compounds of tungsten (the main electrode constituent) from the electrode to the walls of the discharge tube during operation of the lamp. The tungsten, in its various compound forms so transported, creates an opaque barrier on the inner wall of the arc tube, thus preventing discharge radiation from being effectively transmitted. In short, significant losses to the level of lumens can occur. This loss of light level from within the discharge is perceived externally as a reduction of light output of the lamp, and thereby reduction in the maintenance of initial lumens. It is believed that the transport of tungsten and tungsten compounds to the walls of the discharge tube occurs through sputtering, evaporation and other chemical mechanisms.

To reduce the transport of tungsten and tungsten compounds to the walls of the discharge tube, a type of MHL lamp has been designed where the cold fill pressure of the inert gas in the arc discharge chamber is increased to a value of at least 50 torr, with the preferred fill pressure being 70 torr and possibly greater than 110 torr. While this design has successfully reduced the transfer of metallic and inorganic compounds, the increased fill pressure, requires a higher than normal starting voltage. Therefore, a voltage multiplier circuit is incorporated into the lamp to assist in the lamp ignition procedure.

The voltage multiplier circuit uses a semiconductor device, such as a diode. Unfortunately, the high temperature creates an environment where metal from the connections is able to diffuse into the semiconductor diode, gradually increasing the diode reverse leakage current. The increase of diode reverse leakage current is destructive and limits the diode usable life.

BRIEF SUMMARY OF THE INVENTION

The present invention provides an active device and method to protect the starting circuit diode, in metal halide lamps from being destroyed.

A metal halide lamp incorporating this invention comprises an arc tube containing an ionizable medium and having electrodes, preferably tungsten, sealed into opposed ends of the arc tube. An outer envelope encloses the arc tube and includes one end accommodating inleads sealed therethrough. A base is attached to the outer envelope and includes input terminals, the input terminals being connected to the inleads which in turn are connected to the tungsten electrodes. The ionizable medium includes mercury, metal halides, and an inert gas selected from the group consisting of argon, krypton, xenon and mixtures thereof. The inert gas will be at a cold pressure of at least about 50 torr. The lamp incorporates a starting circuit, having a voltage multiplying circuit portion connected to the starter electrode, to provide an increased starting voltage to the starter electrode. Also included as part of the starter circuit is a disabling circuit portion, which either removes the voltage multiplying portion out of the circuit, or shorts the voltage multiplying circuit to the starter electrodes, after the lamp has been started. The disclosed active protection device is inexpensive to manufacture, requires little added labor, and is easily retrofitted to existing manufacturing processes.

DETAILED DESCRIPTION OF THE INVENTION

Figure 1:
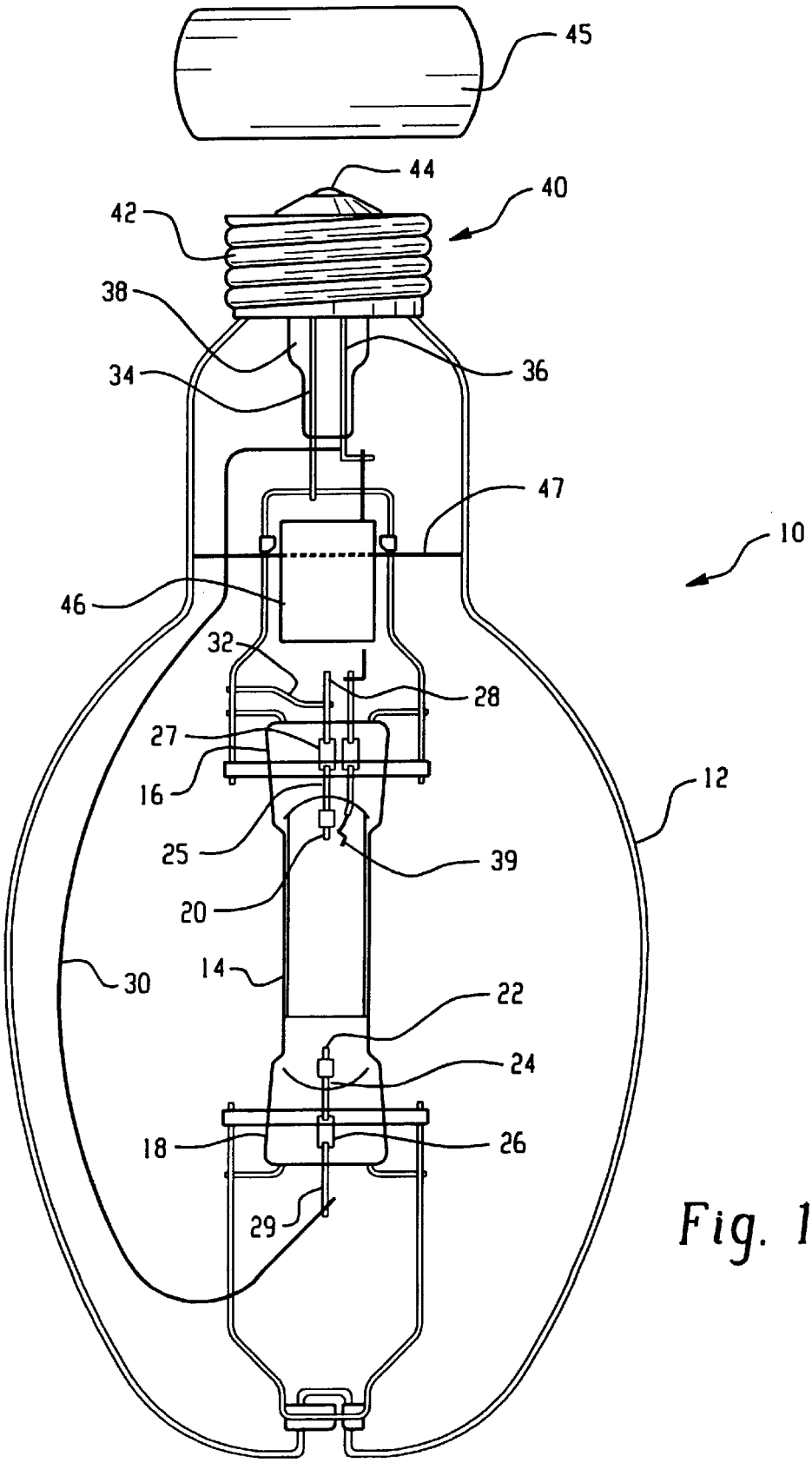
FIG. 1 is a front view of a prior art metal halide lamp with a starting circuit suitable for adaptation to the present invention.

Referring now to FIG. 1, a metal halide lamp 10 is depicted to which the present invention is basically suited. In one embodiment lamp 10 may be rated at 400 watts, however, the present invention may also be used with other rated lamps, for example in the range of 175–1500 watts.

Lamp 10 comprises an outer glass envelope 12 containing a quartz or fused silica arc tube 14 having flat pressed or pinched ends 16, 18. Main electrodes 20, 22 are mounted in opposite ends of arc tube 14, each including a shank portion 24, 25 which extends to a molybdenum foil 26, 27 to which current conductor 28, 29 are respectively connected. A lamp which corresponds to the lamp described above is disclosed in U.S. Ser. No. 09/290,008 entitled, Improved Metal Halide Lamp, Ramaiah et. al., filed 04/09/1999, and hereby incorporated by reference.

Main electrodes 20, 22 are connected by conductors 30, 32 to outer envelope inleads 34, 36 sealed through stem 38 of the outer envelope 12. Starter electrode 39 is provided at the upper end of arc tube 14 close to main electrode 20, and consists of an inwardly projecting end of a fine wire. The outer envelope inleads 34, 36 are connected to the contact surfaces of screw base 40 attached to the neck end of the envelope, that is to the threaded shell 42 and to the insulated center contact 44. The threaded shell is designed to be connected to a signal source 45. A starting circuit 46 is generally shown as block component. Also depicted is heat shield 47.

Figure 2A:
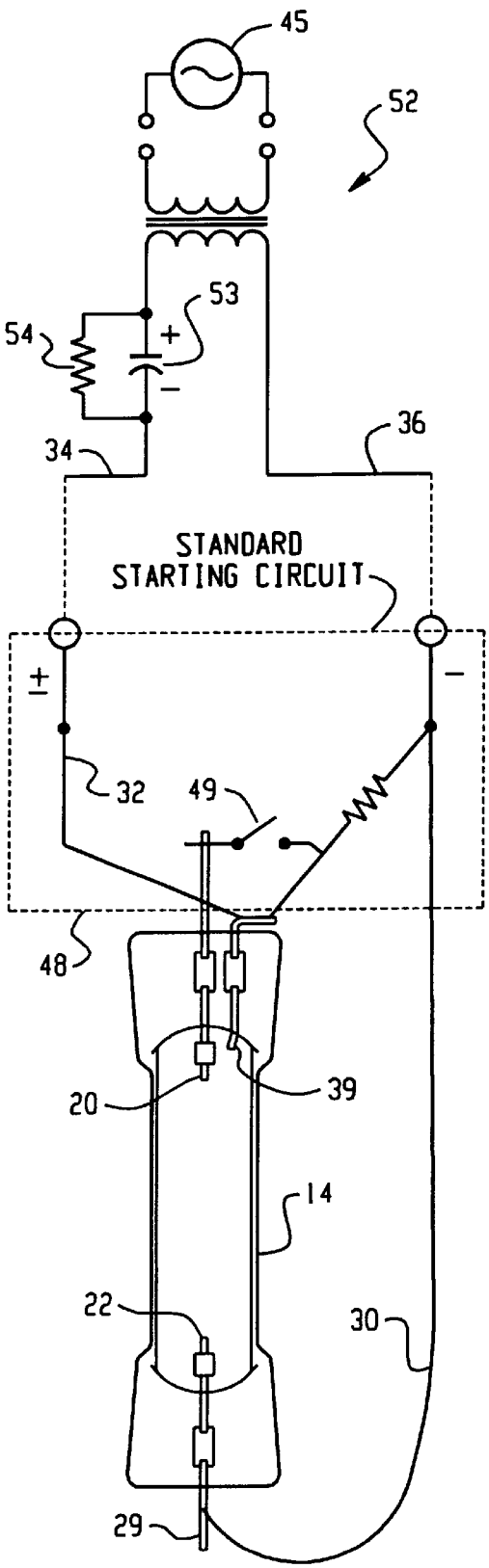
FIG. 2A is a schematic diagram of the standard starting circuit for the lamp of FIG. 1.

A starting circuit, such as represented by block 46 of FIG. 1, is depicted as standard starting circuit 48 in FIG. 2A. This circuit consists of bi-metal starter switch 49 and resistor 50. The lamp is shown connected to ballast 52, which includes a ballast capacitor 53 and ballast resistor arrangement 54. Switch 49 is normally open, and when voltage is first applied to a cold lamp at inleads 34, 36 the voltage is applied across the lamp starter electrode 39 and main electrode 20, facilitating starter-to-main electrode breakdown. Main-to-main electrode breakdown across electrodes 20, 22 follows shortly after starter-to-main breakdown. Once the lamp heats up, switch 49 closes, bringing electrodes 20, 39 to the same potential which prevents damage to pinch end 16 due to electrolysis.

As is now known, if the cold gas fill, primarily the inert gas, is increased sufficiently, there is a minimization of blackening on the quartz wall of the discharge tube. It is believed that this occurs because of a reduction in the mean free path of the sputtered tungsten atoms during the initial start up. Arc tube 14 is provided with an ionizable radiation-generating fill. One suitable filling comprises mercury, sodium iodide, scandium iodide, and at least 50 torr of an inert gas such as argon. It was found, however, that it is not possible to arbitrarily increase the cold fill of a metal halide lamp and still obtain a reliable start using standard metal halide ballasts and the standard starter circuit.

Figure 2B:
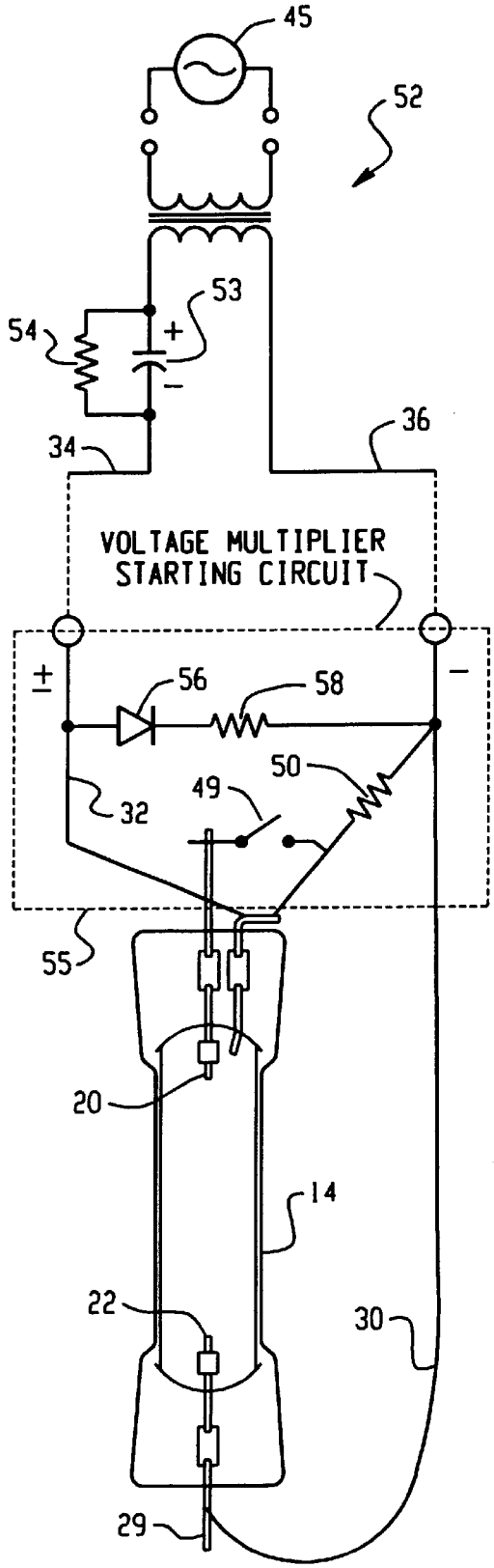
FIG. 2B is a schematic diagram of a voltage multiplying starting circuit for use in a lamp such as shown in FIG. 1.

Turning to FIG. 2B, voltage multiplier starting circuit 55 is used to increase lamp startability in lamps having increased cold fill gas levels. The voltage multiplier circuit 55 consists of two components in addition to those found in the standard starting circuit: diode 56 and resistor 58. When terminal 34 is positive with respect to terminal 36, diode 56 is forward biased. Current flows through diode 56 and resistor 58, allowing ballast capacitor 53 to charge. On the opposite half-cycle, when terminal 36 is positive with respect to terminal 34, diode 56 is reverse biased. No current flows through diode 56 and resistor 58. However, the voltage on capacitor 53 is added to the ballast output, thus multiplying the voltage available at lamp terminals 34, 36 and aiding in lamp starting.

In a lamp having increased cold fill pressure, acceptable starting is achieved by employing voltage multiplying circuit 55 in conjunction with a typically available ballast. However, this circuit allows current to flow through diode 56 during lamp operation. This leads to diode deterioration over time, manifesting itself through increased diode leakage current, which reduces the ability of the circuit to charge ballast capacitor 53. This, in turn, decreases the voltage multiplication generated at the lamp terminals, and thus reduces startability of the lamp.

Figure 3:
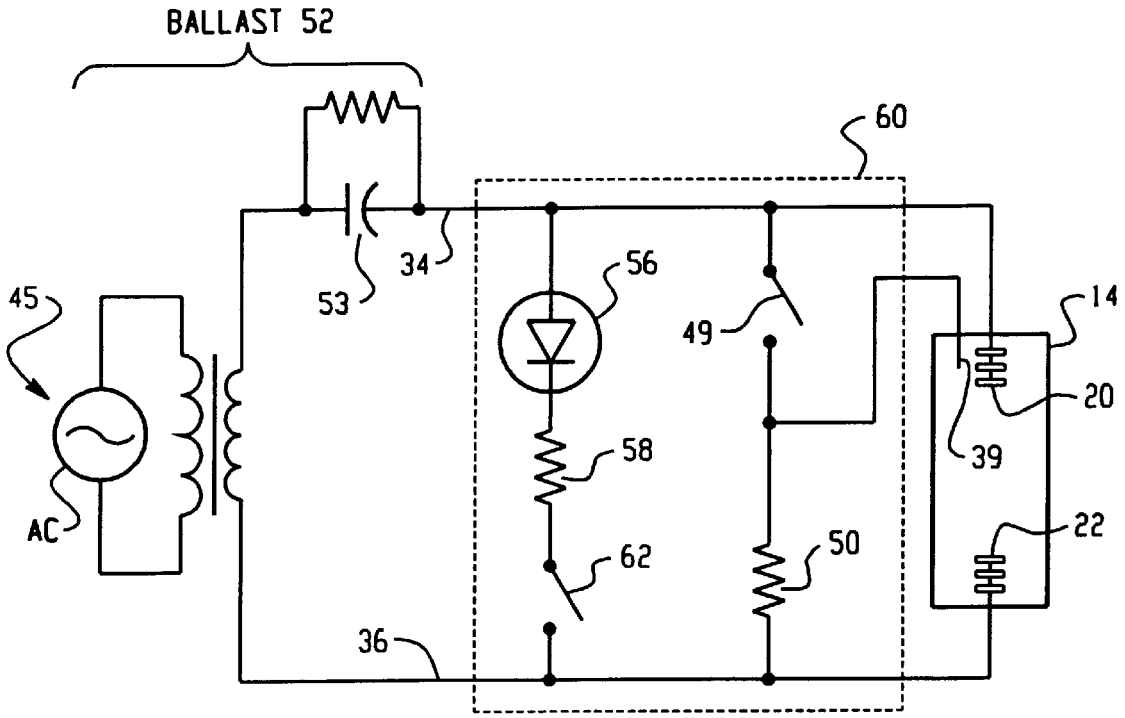
FIG. 3 is a schematic representation of a preferred embodiment of the starting circuit according to the present invention.

To address this problem a schematic of a first embodiment for a starting circuit 60 is shown in FIG. 3. In this embodiment, starting circuit 60 is similar to starting circuit 49 of FIG. 2B but also includes a normally closed disabling bimetal switch 62 which removes diode 56 completely from the circuit once a predetermined temperature is reached. Opening of disabling switch 62 removes the voltage multiplier circuit components (56, 58) from starter circuit 60, thereby removing any bias on diode 56, and preventing diode damage due to current flow during lamp operation.

As a further aspect of the invention, heat shield 47, as shown in FIG. 1, may be interposed between at least diode 56 and arc lamp 14. As illustrated in FIG. 1, starting circuit 46 (depicted in this embodiment in accordance with the description of starting circuit 60) is within envelope 12 of lamp 10. To reduce the heat received by diode 56, heat shield 47, formed of mica or other appropriate material, is interposed to limit the amount of heat radiated to diode 56. It is to be noted that when the present embodiment includes shield 47, the temperature at which disabling switch 62 is intended to open should be lower than in an embodiment where heat shield 47 is not used. The temperature at which the disabling switch is to open is between 100° C. and 250° C., depending on where it is located within the lamp. Use of disabling switch 62 has been found to extend diode life since it is possible to select values so no current flows through diode 56 at temperatures above the rated temperature (e.g. for a specific diode this temperature is 175° C.). Therefore, metal diffusion into the semiconductor diode, and thus diode damage, is greatly reduced.

Figure 4:
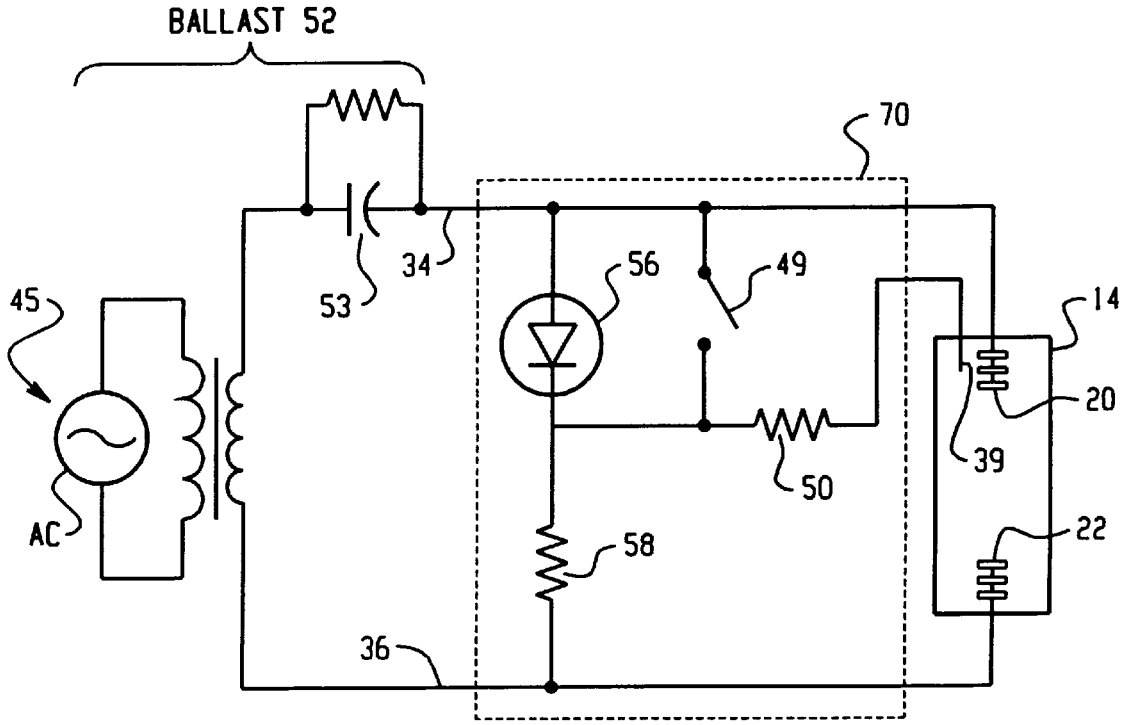
FIG. 4 is a schematic representation of an alternate embodiment of the starting circuit incorporating the invention.

In an alternate embodiment, starting circuit 70 of FIG. 4 is depicted. In this embodiment, starting circuit 70 is similar to starting circuit 49 of FIG. 2B, but bimetal starter switch 49 and resistor 50 are connected in an alternative arrangement. The voltage multiplying circuit portion (56, 58) remains the same as in starter circuit 55 of FIG. 2B. Particularly, the diode/resistor arrangement (56, 58) is connected across the inputs 34 and 36. However, now connected between these series components, is starter switch 49 being used not only for starter electrode 39, but also used for disabling of the voltage multiplying circuit portion (56, 58), in order to protect diode 56. More specifically, switch 49 is now connected in parallel with diode 56. Resistor 50 is connected at a node between diode 56/switch 49 and resistor 58 at one end, and to starter electrode 39 at another. This alternate configuration effectively shorts diode 56 once a predetermined temperature is reached. This feature extends the diode life by minimizing current flow through the diode at temperatures above the rated temperature of diode 56, and hence, greatly reduces metal diffusion into the semiconductor diode. It is understood that some small currents can still flow through diode 56 even when shorted. It is to be appreciated that temperature shield 47 (as depicted in FIG. 1) may also be employed in this embodiment.

Figure 5:
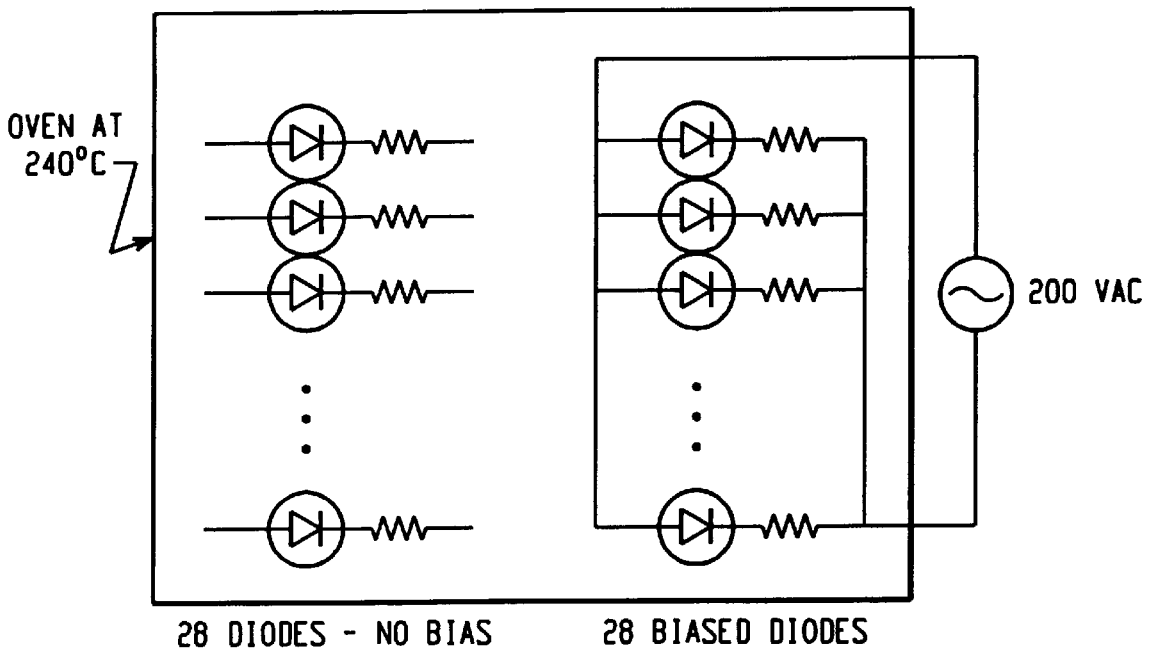
FIG. 5 is a schematic representation of diode component testing performed to evaluate the effectiveness of the invention.
Figure 6:
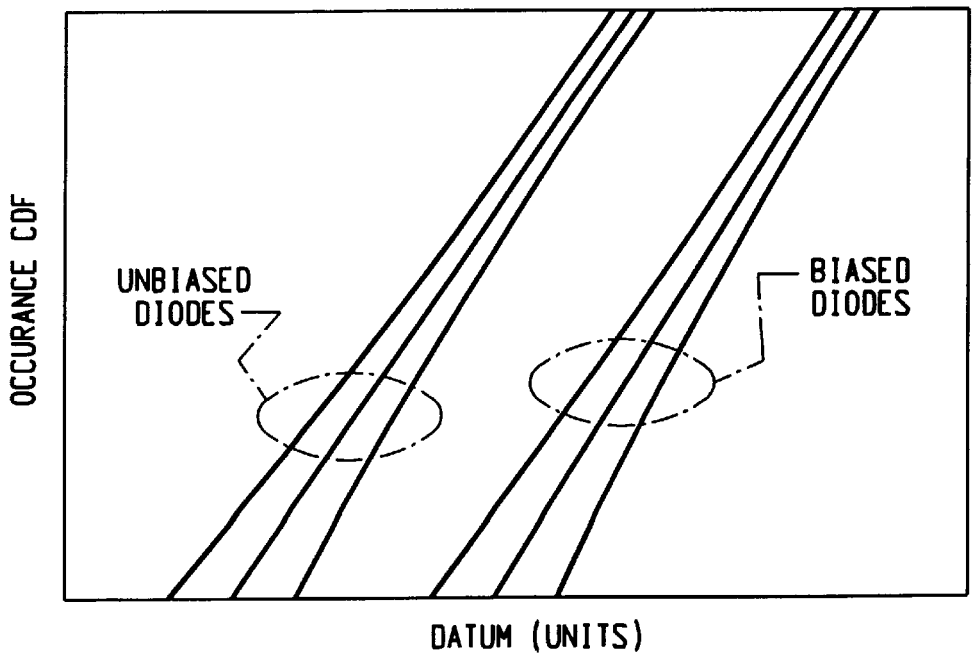
FIG. 6 is a graphical representation of examples evaluating the effect of the invention on extending diode life.

Component testing shown schematically in FIG. 5 depicts a testing procedure undertaken to illustrate the usefulness of removing diode 56 from a biased state. The test consisted of two sets of diodes and resistor pairs, installed into high temperature fixtures and placed in an oven. The oven was set to 240° C. to simulate diode temperature during lamp operation. One set of resistor diode pairs was biased with 200 VAC to simulate voltage potential during operation, and one set was left unbiased to simulate operation in a lamp incorporating the invention.

The components were left in the oven at 240° C. for 700 hours. The oven was then turned off, and once the components cooled, the reverse leakage current of the diodes was checked on a curve tracer. The data was fit to a three parameter Weibull distribution (the data is not normally distributed), and the plot comparing reverse leakage current in microamps for the two groups is displayed in FIG. 8. There is a statistically significant difference in damage, as evidenced by reverse leakage current, between the two groups—the unbiased diodes displayed considerably less damage than the biased diodes. This test demonstrates that eliminating the current to the diodes during operation can significantly decrease damage.

Furthermore, in two separate tests, a total of 21 lamps were built using the embodiment displayed in FIG. 3. These lamps contained higher fill pressure arc tubes 14, filled to about 90 torr argon fill pressure. Test 1, consisting of 8 lamps, has successfully burned for 2,000 hours. Test 2, consisting of 13 lamps, has successfully burned for 1,000 hours. Voltage multiplier circuit effectiveness is evaluated using the metric of peak voltage multiplier (PVM) as shown below:

$$PVM = \frac{V_{peak}(enhanced)}{V_{peak}}$$

In accordance with the defined relationship, the higher the PVM, the greater the starting voltage generated across the lamp. The PVM value generated will depend on the characteristics of the ballast used, and on the condition of the voltage multiplier circuit in the lamp under test.

Test results for 1,000 and 2,000 hours are shown below in Table 1. Test A is a test containing lamps having a voltage multiplier circuit, but does not include the diode protection concepts of the present invention. Tests 1 and 2 used voltage multiplier circuits which incorporate the diode protection concepts of the present invention.

The ballast used in the above testing generated a PVM of 1.74 for a new lamp. It is noted that a lamp with no voltage multiplier circuit, generates a PVM of 1.0. The average PVM for Test A lamps has deteriorated to 1.22 by 1000 hours, and further deteriorated by 2000 hours. Deterioration of this magnitude is unacceptable so early in lamp life.

Lamps in Tests 1 and 2 showed no PVM deterioration at 1000 hours, and at 2000 hours the lamps of Test 1 still showed very little deterioration in the generated PVM, demonstrating the effectiveness of the invention. The results of Test 2, for 2000 hours were not available at the time of this writing.

TABLE 1

| | Average PVM | | |
|---|---|---|---|
| Burn Time (hours) | Test 1 n = 8 | Test 2 n = 13 | Test A n = 21 |
| 1,000 | 1.74 | 1.74 | 1.22 |
| 2,000 | 1.67 | | 1.17 |

Thus, it is apparent that there has been provided, in accordance with the invention, an active method to protect the diode in metal halide lamps that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appending claims.

What is claimed is:

1. A metal halide lamp comprising:

an arc tube containing an ionizable medium, and having main electrodes sealed into opposed ends of the arc tube with a starter electrode sealed into one end of the arc tube adjacent to first of said main electrodes, the ionizable medium including mercury, a metal halide, and an inert gas selected from the group consisting of argon, krypton, and xenon and mixtures thereof; and a starting circuit including, a voltage multiplier circuit portion connected across the main electrodes, wherein the voltage multiplier circuit portion increases the starting voltage applied to the starter electrode, and a disabling circuit portion which at least one of, (i) removes the voltage multiplier circuit portion from the starting circuit or (ii) shorts the voltage multiplier circuit portion to a voltage of the main electrodes, after the lamp has been started.

2. The lamp of claim 1 wherein said inert gas is at a cold pressure of greater than 50 torr.

3. The lamp of claim 1 further including a heat shield inserted between the diode and the arc tube.

4. The lamp of claim 1 wherein the lamp has an operational power rating greater than or equal to about 175 watts.

5. The lamp of claim 1 wherein said electrodes are comprised of tungsten.

6. The lamp of claim 1 wherein said thermal switches are of bimetallic switches.

7. A metal halide lamp comprising:

a vitreous arc tube containing a starter electrode, an ionizable medium and having tungsten electrodes sealed into opposed ends of the arc tube, an outer envelope enclosing the arc tube and including one end accommodating inleads sealed therethrough, a base attached to the outer envelope having input terminals, the input terminals being connected to the inleads which in turn are connected to the tungsten electrodes, a mount supporting the arc tube within the outer envelope, the ionizable medium including mercury, a metal halide, and an inert gas selected from the group consisting of argon, krypton, and xenon and mixtures thereof; and a voltage multiplier starting circuit comprising a rectifier, two resistors and two thermal switches, the rectifier, one of said resistors and one of said thermal switches being connected in series and bridged across said main electrodes, the second of said thermal switches being bridged between said first main electrode and said starter electrode, the second of said resistors being bridged from said starter electrode to said second main electrode, wherein said voltage multiplier starting circuit improvements provide for an active protection of the rectifier.

8. The lamp of claim 7 further including a ballast connected by means of an input terminal to said rectifier, with the capacitor-rectifier junction being connected to said tungsten electrode nearest to said starter electrode serving to provide a positive bias on said starter electrode with respect to said nearest tungsten electrode.

9. The lamp of claim 7 wherein said rectifier is a diode, and said thermal switches are bimetallic switches.

10. The lamp of claim 9 wherein the first of said bimetallic switches is normally closed and designed to open at a temperature between 100° C. and 250° C., and second of said bimetallic switches is normally open and designed to close at a temperature between 100° C. and 250° C.

11. The lamp of claim 7, further including a heat shield inserted between the diode and the arc tube.

12. The lamp claim 7, wherein the lamp has a power rating greater than or equal to ab out 175 watts, and each of said resistors is not less than 5k ohms and not more than 100k ohms.

13. A metal halide lamp comprising:

a vitreous arc tube containing a starter electrode, an ionizable medium and having tungsten electrodes sealed into opposed ends of the arc tube, an outer envelope enclosing the arc tube and including one end accommodating inleads sealed therethrough, a base attached to the outer envelope having input terminals, the input terminals being connected to the inleads which in turn are connected to the tungsten electrodes, a mount supporting the arc tube within the outer envelope, the ionizable medium including mercury, a metal halide, and an inert gas selected from the group consisting of argon, krypton, and xenon and mixtures thereof; and a voltage multiplier starting circuit comprising a rectifier, two resistors and a thermal switch, the rectifier and the first of said resistors being connected in series and bridged across said main electrodes with the rectifier being connected to said first main electrode nearest to said starter electrode, the thermal switch being connected in parallel with the rectifier, the second of said resistors being bridged from said starter electrode to the junction between the rectifier and first of said resistors, wherein said voltage multiplier starting circuit improvements provide active protection method of the rectifier.

14. The lamp of claim 13 further including a ballast connected in series by means of an input terminal to said rectifier, with the capacitor-rectifier junction being connected to said tungsten electrode nearest to said starter electrode serving to provide a positive bias on said starter electrode with respect to said nearest tungsten electrode.

15. The lamp of claim 13 wherein said rectifier is a diode, and said thermal switch is a bimetallic switch.

16. The lamp of claim 15 wherein said bimetallic switch is normally open and designed to close at a temperature between 100° C. and 250° C.

17. The lamp of claim 13, including a heat shield inserted between the diode and the arc tube.

18. The lamp of claim 13, wherein the lamp has a power rating greater than or equal to about 175 watts, and each of said resistors is not less than 5k ohms and not more than 100k ohms.

* * * * *